US005192078A

United States Patent [19]

Woo

[11] Patent Number: 5,192,078

[45] Date of Patent: Mar. 9, 1993

[54] GOLF BALL

[75] Inventor: Young-Kyu Woo, Kwangju, Rep. of Korea

[73] Assignee: Kumho & Company, Inc., Seoul, Rep. of Korea

[21] Appl. No.: 659,503

[22] Filed: Feb. 22, 1991

[30] Foreign Application Priority Data

Apr. 4, 1990 [KR] Rep. of Korea ..... 4677/90

[51] Int. Cl.[5] ..... A63B 37/14

[52] U.S. Cl. ..... 273/232; 40/327

[58] Field of Search ..... 273/232, 220, 62; 40/327

[56] References Cited

U.S. PATENT DOCUMENTS

| | | | |
|---|---|---|---|
| 4,560,168 | 12/1985 | Aoyama | 273/232 |
| 4,729,567 | 3/1988 | Oka et al. | 273/232 |
| 4,744,564 | 5/1988 | Yamada | 273/232 |
| 4,762,326 | 8/1988 | Gobush | 273/232 |
| 4,772,026 | 9/1988 | Gobush | 273/232 |
| 4,804,189 | 2/1989 | Gobush | 273/232 |
| 4,844,472 | 7/1989 | Ihara | 273/232 |
| 4,867,457 | 9/1989 | Ihara | 273/232 |
| 4,949,976 | 8/1990 | Gobush | 273/232 |
| 5,009,427 | 4/1991 | Stiefel et al. | 273/232 |

*Primary Examiner*—George J. Marlo

*Attorney, Agent, or Firm*—Wegner, Cantor, Mueller & Player

[57] ABSTRACT

This invention relates to a golf ball, in which a dimple distribution pattern is designed to secure the greatest possible number of axes of symmetry on the surface of a regular spherical polyhedron based on the surfaces of a regular dodecahedron, a regular icosahedron, or a dodecaicosahedron constituting a golf ball. The golf ball includes two hemispherical portions joined by a mold-parting line formed along a great circle of the golf ball. The dimples that intersect said mold-parting line are removed and replaced with equivalent dimples having aerodynamic characteristics equal to those of the dimples that are removed. The equivalent dimples are arranged in a symmetrical manner across said mold-parting line so that the golf ball may have the maximum non-directional symmetry and aerodynamic characteristics.

7 Claims, 5 Drawing Sheets

GOLF BALL

FIELD OF THE INVENTION

The present invention relates to a golf ball and, more particularly, to a golf ball, on the surface of which such new dents, or dimples (hereinafter to be called equivalent dimples) as have equal or similar aerodynamic characteristics to those of the ordinary dimples are evenly arranged on both sides of the line (hereinafter, the mold-parting line) joining the two hemispheres of a molded golf ball in order to easily adjust both the dimple-free areas and the dimple pattern while keeping the non-directional aerodynamic characteristics of the golf ball.

BACKGROUND OF THE INVENTION

The parting line here in the present invention in the mold-parting line, and at the same time, the very longest circumferential line which can be used as a mold-parting line dividing the orb into two equals; which line no dimple is allowed to intersect; the largest circumference line is one of the great circles dividing the orb in two equal hemispheres, and, unlike a symmetrical line that brings about an exact symmetry in each half, it does not necessarily bring about exact symmetries, but is such an axis as comes forth in a symmetrical position when one half of the orb is moved to a certain degree on a pole formed by one such axis; while the equivalent dimples are any such dimples as having shapes different from those of the ordinary dimples, being arranged in a single or double pairs in a symmetry beyond the mold-parting line, possessing the aerodynamic characteristics equal with or similar to the ordinary dimples, in replacement of those dimples that the mold-parting line intersects.

In production of a golf ball it is desirable to so design one as will ensure that the dimples are arranged in a symmetry with the parting line in the center so that the golfer can find either the parting line or the axis of symmetry with ease when placing the ball in a direction he desires for a tee-shot or putting, and it is also desirable to so arrange the dimples as to have the ball display the same aerodynamic characteristics regardless of which point the golfer strikes, because he is forbidden from readjusting the position of the ball, the only exception being the time of a tee-shot of putting.

With the view of optimizing a golf ball's non-directional aerodynamic characteristics attempts have been made by many to work out a dimple pattern to increase the number of axes of symmetry and largest circumference lines, and of all polyhedrons, a regular dodecahedron, icosahedron, or dodeca-icosahedron has been adopted in most cases to minimize the directional characteristics but maximize the number of axes of symmetry or largest circumference line.

But since a mold-parting line is indispensable in the process of production of a golf ball and since dimples can never be allowed on the mold-parting line, a dimple pattern has been extremely difficult to design by which dimples are evenly arranged, with plenty of axes of symmetry and a minimum of dimple-free areas provided on the surface of a golf ball.

In prior art, too, designs were made to arrange dimples on the basis of the axes of symmetry and the parting line in order to secure as many axes of symmetry as possible, but then, although aerodynamic characteristics improved, the dimple-free areas, too, increased because no dimple could be placed where axes of symmetry or the parting line intersected, and if dimples were rearranged on the parting line also in order to decrease dimple-free areas, the number of axes of symmetry decreased, resulting in a deterioration of the aerodynamic characteristics.

In the U.S. pat. No. 4,560,168, for example, it is apparent from the illustrations that although the 15 axes of symmetry and six great circles are all effectively exploited by way of arranging dimples making use of the six great circles quartering the spherical triangles of the icosahedron as a parting line, the dimple-free areas increase because it is necessary to arrange dimples in the equilateral triangles with the parting lines as their sides in a manner not to allow these dimples to intersect the parting lines.

Then in case these dimple-free areas are decreased, as in the U.S. Pat. No. 4,804,189, the number of axes of symmetry decreases to six or fewer, five of which having no directional traits at all, because it is necessary to adjust the locations and sizes of dimples alongside the parting lines in a manner where no dimple should intersect the mold-parting line; and so it becomes impossible to design a dimple pattern with non-directional aerodynamic characteristics.

In the U.S. Pat. No. 4,844,472, as another example, although it has as many as 15 axes of symmetry, which can be used as parting lines, on the basis of a regular icosahedron, it requires, as is apparent from the drawings, a distribution of exceedingly small dimples in those positions in which three of five axes of symmetry intersect, and despite all this there are left a number of dimple-free areas of fairly large size at the same points of intersection.

Now an objective of the present invention is to provide a golf ball which, with a dimple pattern to ensure an even and uniform arrangement of dimples on its surface designed by the use of a polyhedron of a certain form, is to have the largest number of axes of symmetry and largest circumference line according to the characteristics of the sides which constitute the polyhedron, disregarding whether or not dimples become intersected, but using as the mold-parting line one of the lines which, however, allow the least number of dimples to be intersected, and by eliminating only these least number of dimples that may become intersected, thereby minimizing dimple-free areas.

Another objective of the present invention is to provide a golf ball with the maximum non-directional symmetry by means of arranging a new equivalent dimples which have aerodynamic characteristics about equal to those of the ordinary dimples in the areas alongside the parting line whence the intersecting dimples are eliminated; that is, the dimple-free areas.

SUMMARY OF THE INVENTION

To overcome the problems of prior art and in accordance with the purpose of the invention, as embodied and broadly described herein;

A golf ball comprises dimples, arranged on the surface of a regular spherical polyhedron based on any one of regular icosahedrons, regular dodecahedrons, and regular icosa-dodecahedrons in a manner to ensure a maximum of axes of symmetry or a maximum of largest circumference lines; and dimple-free areas, from which those dimples that intersect the mold-parting line are removed, said mold-parting line being one of said axes of symmetry and shifting axes of symmetry with the fewest dimples that intersect said axes of symmetry or said shifting axes of symmetry.

A golf ball further has equivalent dimples with aerodynamic characteristics equal to those of the removed dimples, arranged in said dimple-free areas in a manner that said equivalent dimples will be positioned symmetrically beyond said mold-parting line.

BRIEF DESCRIPTION OF DRAWINGS

In the accompanying drawings are shown illustrative embodiments of the invention from which these and others of its objectives, novel features, and advantages will be readily seen.

In the drawings.

DESCRIPTION OF THE PREFERRED EMBODIMENTS

Figure 1:
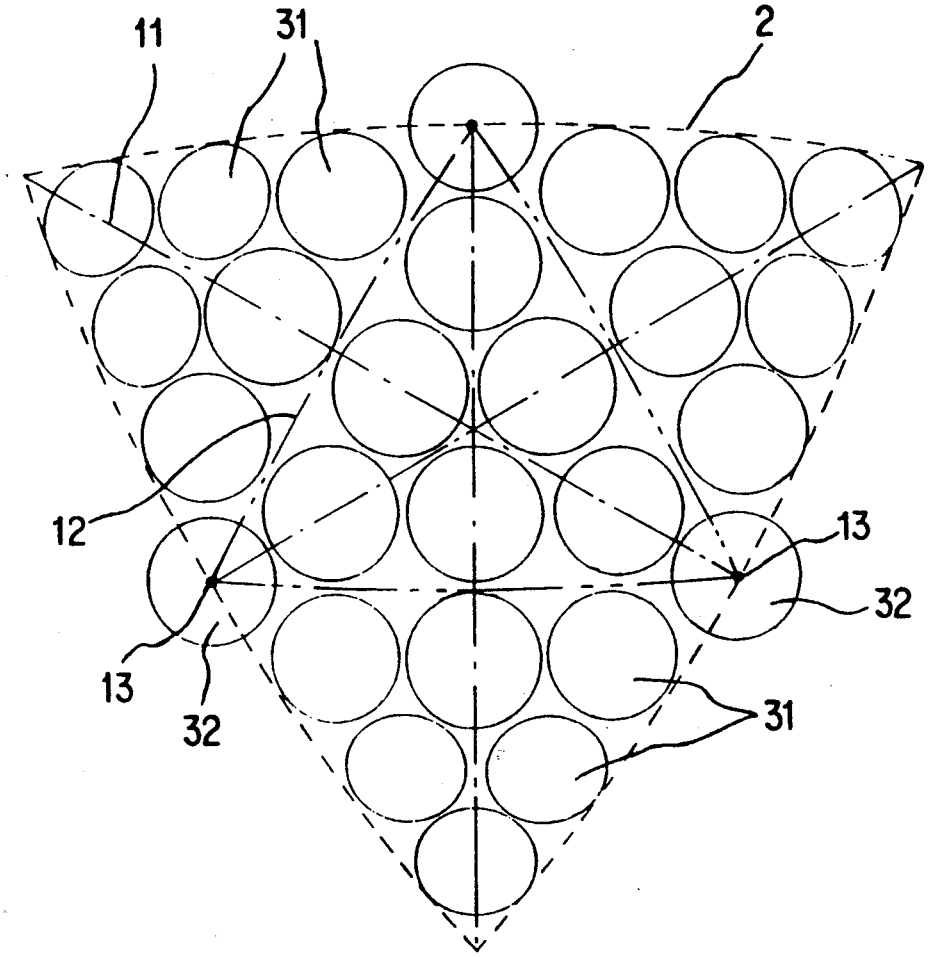
FIG. 1 illustrates a distribution of dimples, i.e., the depressions or dents, done in a manner, in accordance with the present invention, to minimize bald patches or dimple-free areas, while keeping all the possible axes of symmetry, on one of the 20 regular spherical triangles based on a regular icosahedron that covers the entire surface of a golf ball.

Now, further explanation of the present invention will be given below by making use of an example and with the aid of drawings:

FIG. 1 illustrates a dimple pattern having all the 15 axes of symmetry (11) and six great circles (12) at most, in which the dimple-free areas are minimized by means of arranging dimples (31) (32) equally in a spherical triangle (2) based on a regular icosahedron.

As it was impossible, in prior art, to arrange dimples (32) at positions where axes of symmetry (11) and great circles (12) intersected, while at the same time maintaining the non-directional symmetry of dimple distribution, all the dimples in such positions as were usable as mold-parting lines, regardless of whether they are actually used as mold-parting lines or not, must need be eliminated from points of intersection (13), causing to give rise to exceedingly many dimple-free areas.

Figure 2:
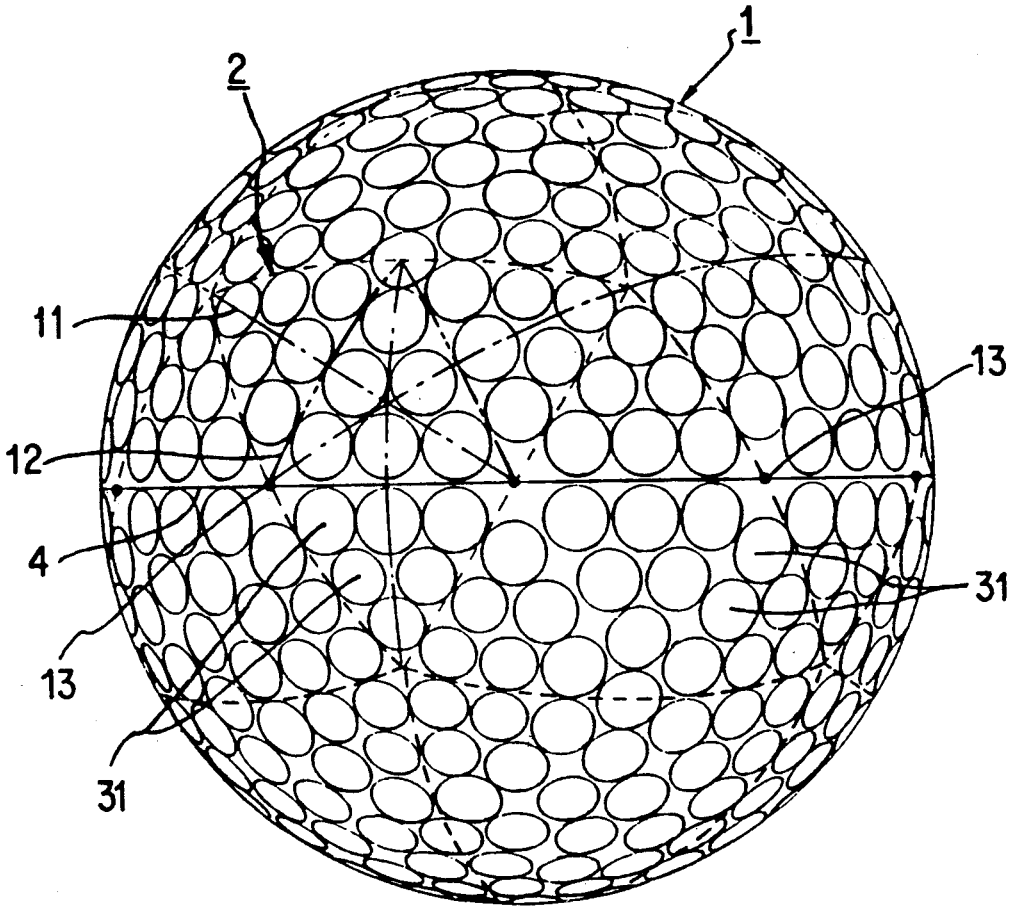
FIG. 2 illustrates a pattern of dimple distribution of FIG. 1, in which, however, those dimples are eliminated that have to intersect the mold-parting line on the surface of a golf ball.

FIG. 2 shows a golf ball, from which only those dimples (32) at the points of intersection (13) alongside the mold-parting line are eliminated after dimples are arranged in a manner shown in the pattern in FIG. 1 on all the surface of the orb, based on a regular icosahedron.

In other words, it shows how the surface will look when one of the axes of symmetry (11) or great circles (12) which have the least number of intersecting dimples is adopted for use for the mold-parting line (4), and the dimples are eliminated only from the positions of intersection (13) on the parting line (4).

An even arrangement of dimples (31, 32) is seen in other areas than the parting line (4) then.

Figure 3:
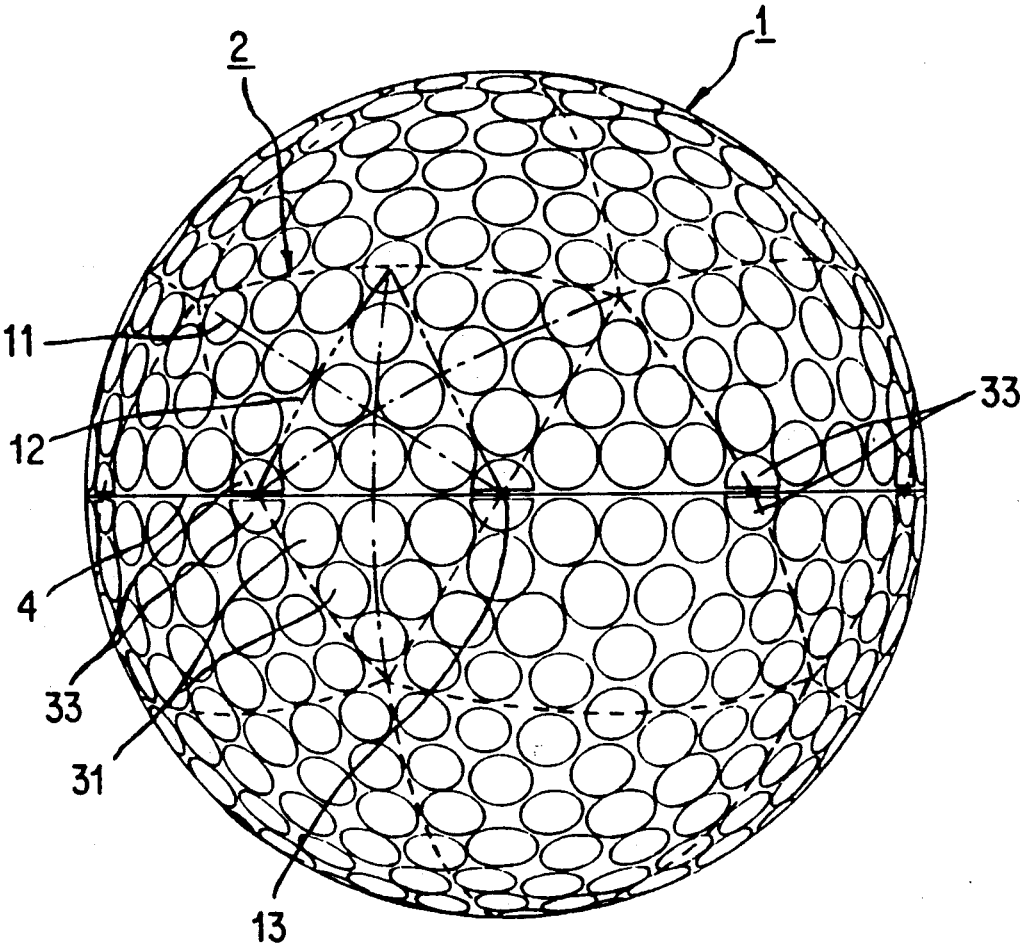
FIG. 3 illustrates semispherical equivalent dimples in accordance with the present invention, distributed in the dimple-free areas alongside the mold-parting line that come into being when the ordinary dimples of FIG. 2 are eliminated.
Figure 4:
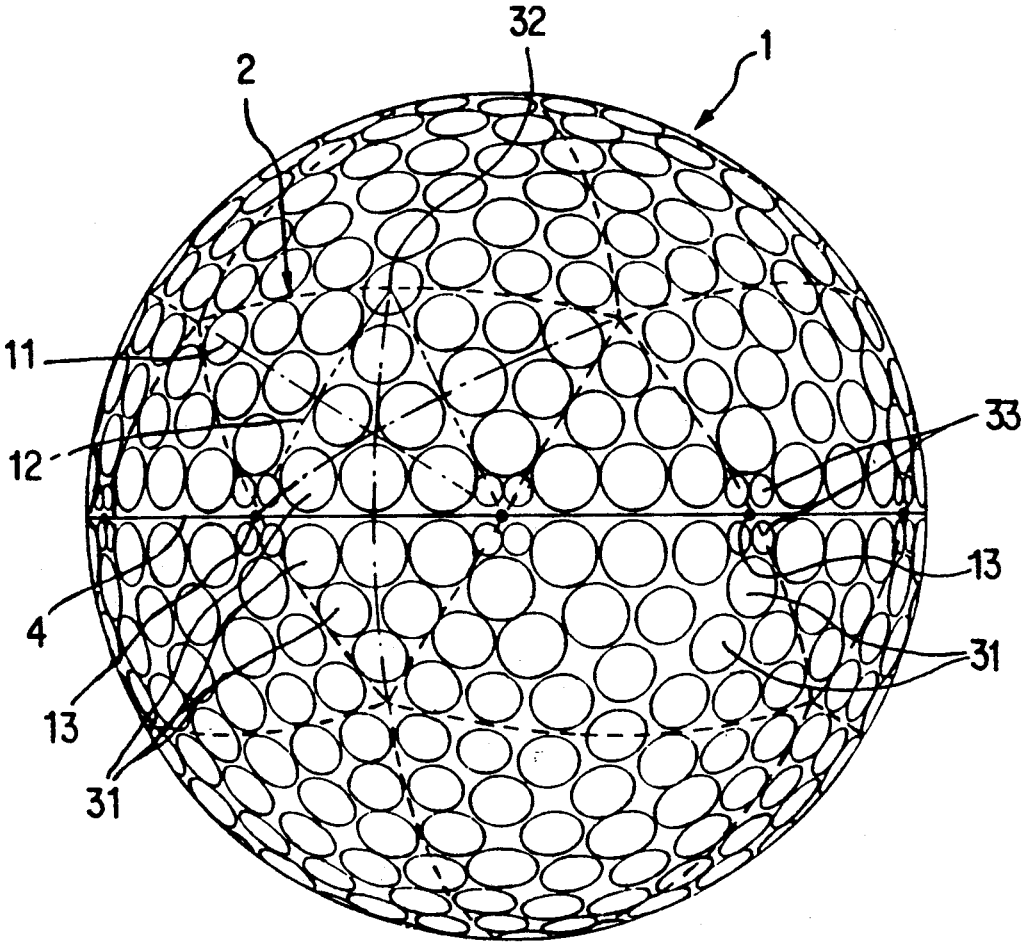
FIG. 4 illustrates equivalent dimples smaller than the ordinary dimples according to another preferred embodiment of the present invention.
Figure 5:
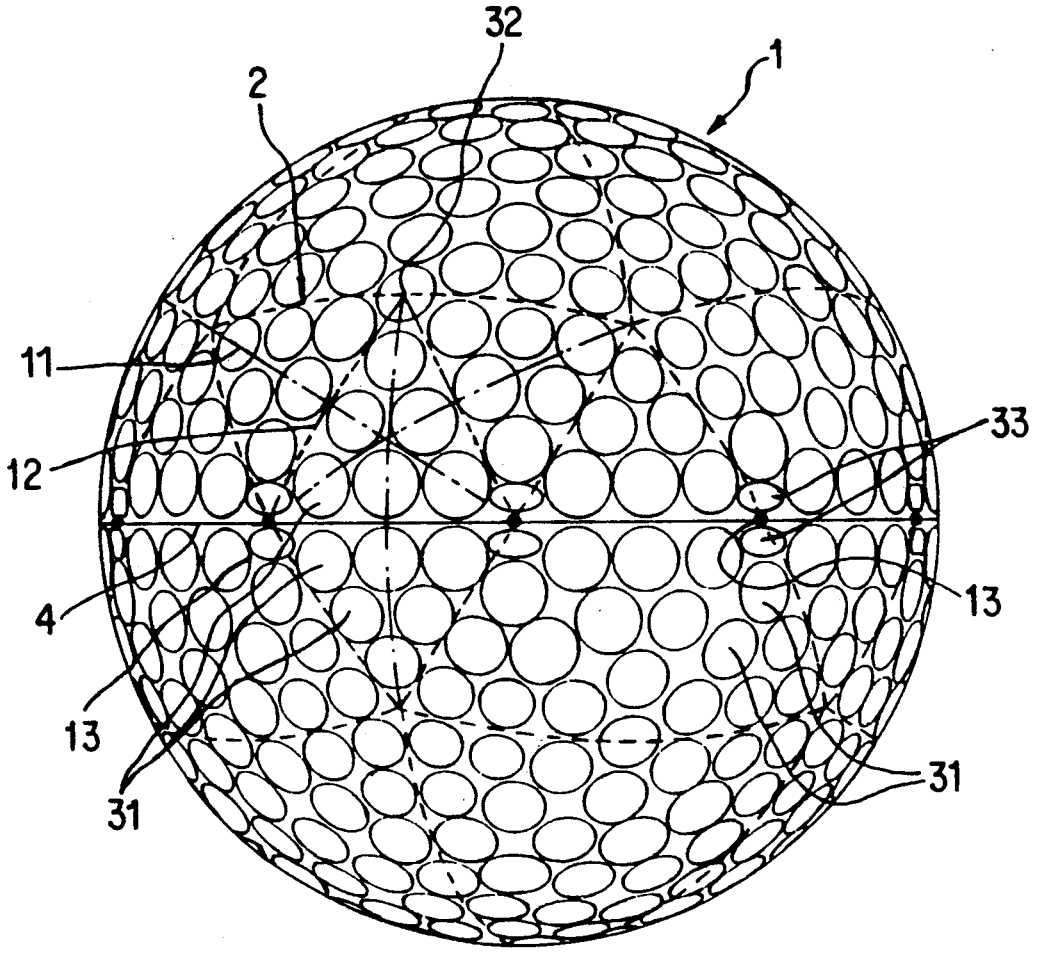
FIG. 5 illustrates elliptical equivalent dimples according to still another preferred embodiment of the present invention.

FIG. 3 illustrates a case, where semi-circular dimples (33), a kind of equivalent dimples in accordance with the present invention, are arranged in a manner to make up symmetry alongside the parting line in the center, at the positions of intersection (13), i.e., the dimple-free areas of FIG. 2 from which dimples (32) have been eliminated.

Equivalent dimples (33) are not necessarily to be semi-circles, but can be of any shape if only they are symmetrical beyond the parting line (4) and have aerodynamic characteristics identical with or equivalent to those of the ordinary dimples (31).

It is to be seen even without experimentations that the golf ball (1) of the present invention, having 15 axes of symmetry (11) and six great circles (12), having an even symmetry on the entire surface of the ball (1), and having a minimum of dimple-free areas, will ideally display its non-directional aerodynamic characteristics.

As has been stated above, the present invention has its advantages. One is the possibility to design a dimple arrangement pattern which ensures possession of the greatest possible number of axes of symmetry and great circles in accordance with the traits of the sides of each polyhedron constituting a golf ball; another is its possibility, by arranging equivalent dimples with equal aerodynamic characteristics to those of the original dimples at the positions of dimples that will otherwise intersect the axis that is used as the parting line, of all the axes of symmetry or the great circles, to minimize the dimple-free areas and bestow upon the golf ball a peculiar non-directional symmetry itself as well.

It should also be understood that the foregoing relates to only a preferred embodiment of the invention, and that it is intended to cover all changes and modifications of the example of the invention herein chosen for the purposes of the disclosure, which do not constitute departures from the spirit and scope of the invention.

What is claimed is:

1. A molded golf ball having a dimpled spherical surface definable as an icosahedron of regular spherical triangles, and comprising:

two hemispheres joined by a mold-parting line, said mold-parting line being devoid of any dimples and disposed along a great circle of said spherical surface;

a plurality of first dimples disposed within said regular spherical triangles;

a plurality of intersecting points formed by intersections of sides of some of said regular spherical triangles and said mold-parting line; and a plurality of pairs of second dimples, with at least one pair of said second dimples being disposed at each of said intersecting points and exhibiting aerodynamic characteristics generally equivalent to at least one of said first dimples, and said second dimples of each said pair being located on opposite sides of said mold-parting line.

2. A golf ball as in claim 1, and further comprising:

an additional first dimple generally centered on each side of said regular spherical triangles except said sides which intersect said mold-parting line.

3. A golf ball as in claim 1, and further comprising:

said at least one pair of second dimples exhibiting aerodynamic characteristics which are generally equivalent to aerodynamic characteristics of each of said first dimples.

4. A golf ball as in claim 1, and further comprising: all of said first dimples being generally equal in shape and size.

5. A golf ball as in claim 1, wherein said second dimples are semi-spherical.

6. A golf ball as in claim 1, wherein said second dimples are smaller than said first dimples.

7. A golf ball as in claim 1, wherein said second dimples are elliptical.

* * * * *